US006358336B1

(12) United States Patent
Miyata

(10) Patent No.: US 6,358,336 B1
(45) Date of Patent: Mar. 19, 2002

(54) HEAT RESISTANCE CR-MO ALLOY STEEL

(75) Inventor: Kaori Miyata, Neyagawa (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/651,113

(22) Filed: Aug. 30, 2000

(30) Foreign Application Priority Data

Aug. 31, 1999 (JP) ..... 11-244218

(51) Int. Cl.[7] ..... C22C 38/22; C22C 38/26; C22C 38/44; C22C 38/48

(52) U.S. Cl. ..... 148/328; 148/330; 148/334; 148/335; 420/106; 420/110; 420/111

(58) Field of Search ..... 148/328, 330, 148/334, 335; 420/106, 110, 111

(56) References Cited

U.S. PATENT DOCUMENTS

| | | | | |
|---|---|---|---|---|
| 4,988,393 A | * | 1/1991 | Yamaba et al. | 148/320 |
| 5,211,909 A | * | 5/1993 | Iseda et al. | 420/106 |
| 5,876,521 A | | 3/1999 | Koo et al. | 148/328 |

FOREIGN PATENT DOCUMENTS

| | | |
|---|---|---|
| AU | 564998 | 9/1987 |
| EP | 0882808 | 12/1998 |
| GB | 2186594 | 8/1987 |
| JP | 01316441 | 12/1989 |
| JP | 03053045 | 3/1991 |
| JP | 04268040 | 9/1992 |
| JP | 05345949 | 12/1993 |
| JP | 08134585 | 5/1996 |
| JP | 09271746 | 8/1997 |
| JP | 11-502259 | 2/1999 |

OTHER PUBLICATIONS

M.I. Gol'dshtein: "Carbonitride Hardening Of Low–Alloy Steels", Metal Science and Heat Treatment, vol. 21, No. 7, Jul. 1979, pp. 487–489.

* cited by examiner

*Primary Examiner*—Deborah Yee
(74) *Attorney, Agent, or Firm*—Clark & Brody

(57) ABSTRACT

A heat-resistant steel contains 0.1–3 mass % of Cr and satisfies the following equation: 0.1≦Nb+Mo+V and MX-type complex precipitates formed inside microcrystalline grains contain 30 mass % or more of Mo and 7 mass % or more of Nb. Also provided is a process for producing the alloy steel product involving casting, forging, hot rolling, normalizing, optionally direct quenching, cooling at a predetermined cooling rate, and tempering.

13 Claims, No Drawings

HEAT RESISTANCE CR-MO ALLOY STEEL

This application claims priority under 35 U.S.C.§ §119 and/or 365 to Japan Patent Application No.11-244218 filed in Japan on Aug. 31, 1999, the entire content of which is herein incorporated by reference.

BACKGROUND OF THE INVENTION

1. Field of the Invention

The present invention relates to a heat-resistant Cr—Mo alloy steel which has excellent high-temperature strength and toughness and which is suitable for use in steel tubes for heat exchangers and piping, heat-resistant valves, and joints employed in the field of boiler, chemical and atomic industries. The invention also relates to a process for producing the steel.

2. Description of the Related Art

Heat-resistant steels which are used at temperatures as high as 400° C. or more are broadly classified into four types: (1) austenitic stainless steel; (2) high-Cr ferritic steel containing 9–12% Cr; (3) Cr—Mo alloy steel containing a few % Cr; and (4) carbon steel.

Steels of these types are appropriately selected in consideration of economical advantage and service conditions, such as temperature and pressure, under which the steel is to be used.

Among these steels, Cr—Mo alloy steel is a heat-resistant steel which typically contains a few % of Cr, and Mo and W as the optional alloying elements and has a tempered martensite or tempered bainite structure.

Cr—Mo alloy steel, due to the element Cr contained, is characterized by its superiority to carbon steel in terms of excellent oxidation resistance, high-temperature corrosion resistance, and high-temperature strength. Cr—Mo alloy steel is inexpensive, has a small thermal expansion coefficient, and has excellent toughness, weldability, and thermal conductivity.

High-temperature strength is a very important property in designing pressure member (i.e., material to be used in under high pressure), and steels for producing pressure member should preferably have high strength regardless of the temperature at which the steel is to be used. Particularly, the wall thickness of heat- and pressure-resistant steel tubes employed in the boiler, chemical and atomic industries is determined in accordance with the high-temperature strength of the steel.

High-temperature strength of Cr—Mo alloy steel is improved by solution strengthening and precipitation strengthening. Typically, solution strengthening is attained by adding appropriate amounts of C, Cr, Mo, and W into steel, to thereby improve high-temperature strength. However, when the thus-strengthened steel is used at high temperature for a long period of time, carbide particles are coarsened and intermetallic compounds precipitate, thereby lowering creep strength under high-temperature conditions and after passage of a prolonged period of time. In order to enhance high-temperature strength, an increase in amounts of solute elements is a possible means for potentiating solution strengthening. However, addition of solute elements beyond their solubility limit causes precipitation of these elements, thereby lowering ductility, workability, and weldability.

Precipitation strengthening is attained by adding precipitation-strengthening elements such as V, Nb, and Ti Such Cr—Mo steels are disclosed in, for example, Japanese Patent Application Laid-Open (kokai) Nos. 57-131349, 57-131350, 59-226152, and 8-158022 and some of them have already been put into practical use. In addition, as precipitation-strengthened Cr—Mo alloy steels, 1Cr—1Mo-0.25V steel serving as turbine material and 2.25Cr—1Mo—Nb steel serving as material used for a fast-breeder reactor are well known.

Japan Kohyo Patent Publication No. 11-502259 discloses heat-resistant 0.5–1.5% Cr-0.1–1.15% Mo ferritic steel to which the following elements have been added: V and Nb serving as precipitation-strengthening elements; B serving as a control element of a matrix structure; and optionally W and Ti.

However, in case of precipitation strengthening, the control of microstructure is difficult, and the following problems arise:

(a) Although strengthened steel as produced or strengthened steel which is used at high temperature for only a short period of time exhibits high strength, the strengthening effect deteriorates when these steels are exposed to high temperature for 10,000 hours or more, and thus high-temperature strength deteriorates. Carbides and nitrides precipitated in as-produced steel or short-time-served steel are effective for precipitation strengthening. However, these precipitates are coarsened by an aging which occurs during a long term use at high-temperature, and strengthening effect deteriorates; and (b) Since precipitation-strengthened steels strengthen inside grains, strength of grain boundaries becomes relatively weak, thereby lowering toughness, ductility and corrosion resistance.

If high-temperature strength of Cr—Mo alloy steel can be further enhanced, the following advantages are obtained:

1) Conventionally, austenitic stainless steel or high-Cr ferritic steel has been employed so as to ensure high-temperature strength even under conditions of use which do not require strict high-temperature corrosion resistance. If Cr—Mo alloy steel of improved high-temperature strength is employed in place of these steels, there can be obtained beneficial properties inherent to Cr—Mo steel, such as excellent weldability, thermal conductivity, fatigue resistance, and low cost;

2) The thickness of conventionally used steel product can be reduced, thereby elevating thermal conductivity and improving thermal efficiency of plants. In addition, thermal stress caused by startup and shutdown of plants can be mitigated; and 3) the decrease in weight of steel products due to reduction of thickness results in size-reduction of plants and reduction of production costs.

SUMMARY OF THE INVENTION

In view of the foregoing, an object of the present invention is to provide a Cr—Mo alloy steel which exhibits high creep strength at temperatures as high as approximately 400–600° C.; which maintains strength even when the steel is used for long periods within such a temperature range; which further exhibits suppressed temper embrittlement; and which has excellent toughness. Another aspect of this invention is to provide a process for producing the steel. The summary of the invention will be described next. Accordingly, the present invention provides the following [1] to [3].

[1] a Cr—Mo alloy steel which comprises, on a mass % basis,

| | |
|---|---|
| C: 0.01–0.25%, | Si: 0.01–0.7% |
| Mn: 0.01–1%, | P: 0.03% or less, |
| S: 0.015% or less, | Cr: 0.1–3%, |
| Nb: 0.005–0.2%, | Mo: 0.01–2.5%, |
| Ca: 0.0001–0.01%, | N: 0.0005–0.01%, |
| B: 0.0001–0.01%, and | |

which satisfies the following expression:

$$0.1 \leqq Nb+Mo+V$$

wherein each element symbol denotes content thereof (mass %), wherein MX-type complex precipitates formed inside grains of the steel contain 30 mass % or more of Mo and 7 mass % or more of Nb.

[2] a process for producing Cr—Mo alloy steel product which has excellent high-temperature strength and toughness, which process comprises: casting a Cr—Mo alloy steel having a chemical composition as described in [1] into a product; optionally forging and hot-working the product; normalizing the as cast, forged or hot-worked product at 950° C. or higher; cooling the product to room temperature; and tempering the product, wherein cooling in the temperature range of 850° C. to 650° C. is carried out at an average cooling rate equal to or faster than both a cooling rate A represented by the following equation (1) and a cooling rate B represented by the following equation (2), and tempering is carried out in a temperature range defined by the following equations (3) and (4):

$$A=0.6\times\log(Nb)+1.24 \quad (1);$$

$$B=0.1\times\log(C+N)+0.3 \quad (2);$$

$$C=780-125\times Mo/(Mo+Nb) \quad (3); \text{ and}$$

$$D=780+100\times Nb/(Mo+Nb) \quad (4).$$

[3] a process for producing Cr—Mo alloy steel product which has excellent high-temperature strength and toughness, which process comprises: hot-rolling a Cr—Mo alloy steel having a chemical composition as described in [1] into a product; finishing the product in a temperature range of 1100° C. to 900° C.; cooling the product to 200° C. or lower; and tempering the product; wherein cooling in the temperature range of 850° C. to 650° C. is carried out at an average cooling rate equal to or faster than both a cooling rate A represented by the above equation (1) and a cooling rate B represented by the above equation (2), and tempering is carried out in a temperature range defined by the above formulas (3) and (4).

In the present invention, the heat-resistant steel is typically applied for steel products formed through hot working and also includes steel products as cast condition. The average cooling rate is defined as a cooling rate of the surface of a steel product which is subjected to heat treatment and is represented by the following relationship.

$$200° \text{ C.}/(\text{time requiring for cooling from } 850° \text{ C. to } 650° \text{ C.})$$

In the present invention, M in MX represents a metallic element such as Nb, V, or Mo; and X in MX represents C and N serving as interstitial elements. The atomic ratio of M to X is 1:1.

The present inventors have studied on the precipitation strengthening due to carbides in order to enhance high-temperature strength of Cr—Mo alloy steel, particularly creep strength at 400° C. or higher, and enhance toughness after tempering. The inventors have performed a variety of tests in connection with precipitation behavior of carbides inside grains and grain boundary strength at a temperature as high as 400° C. or more, and have accomplished the present invention on the basis of the findings described below.

a) In Cr—Mo alloy steel, MX-type complex precipitates provide strong precipitation strengthening effect as compared with other precipitates and are effective for enhancing creep strength.

b) MX is precipitated inside grains, and the compositional elements of MX vary depending on chemical composition and heat treatment conditions of the steel. For example, when Mo and Nb are added to steel, M in MX is composed of Mo and Nb. Similarly, when Mo, Nb, and V are added to steel, M in MX is composed of Mo, Nb, and V. Ti and Zr may also be M in MX.

c) Coarsening of MX is suppressed when MX is present in a form of complex precipitates; i.e., (Mo, Nb, V, Zr, Ti)(C, N), in which metallic elements such as Mo, Nb, V, Zr, and Ti and interstitial elements; i.e., C and N, are completely mixed. In this case, fine MX precipitates are constantly retained with high density and thereby long-term precipitation strengthening is ensured, even after the steel is used at high temperature for long periods.

In contrast, when metallic elements such as Mo, Nb, V, Zr, and Ti are individually precipitated as MX at various sites; e.g., carbides or nitrides such as MoC, NbC, and VC are separately precipitated or certain precipitates around another particles as precipitation nuclei, some of precipitates are rapidly coarsened, thereby lowering precipitation strengthening effect.

d) Even when metallic elements such as Mo, Nb, V, Zr, and Ti are precipitated in a complex state, a failure to satisfy the following conditions promotes coarsening of specific precipitates, thereby losing long-term precipitation strengthening effect. Such condition is that more than 80% of MX precipitates contain 30 mass % or more of Mo and 7 mass % or more of Nb, and 10 mass % or more of V when the steel contains V.

e) Even though portions inside grains are strengthened by fine MX precipitates, deterioration of toughness, such as temper embrittlement or creep embrittlement, occurs when impurity elements which weaken grain boundary strength are segregated in grain boundaries.

f) In order to prevent deterioration of toughness, appropriate amounts of Ca, B, and, if requited, Zr are preferably added in the steel.

DETAILED DESCRIPTION OF THE INVENTION

The reasons why the chemical composition of heat-resistant steel and composition of precipitates must be limited as defined by the present invention will next be described in detail. Throughout the description hereunder, % indicating the amount of chemical elements contained in steel refers to mass %.

C: 0.01% to 0.25%

C, together with N, combines with Nb, V, Ti, Zr, or similar elements, to thereby form MX-type carbonitrides and to contribute to improvement of high-temperature strength of the steel. C itself serves as an austenite-stabilizing element, and stabilizes the microcrystalline structure of the steel.

When the C content is less than 0.01%, the precipitation amount of carbide is insufficient and hardenability of the steel is impaired, resulting in lowering strength and toughness of the steel. In contrast, when the C content is in excess of 0.25%, carbide precipitates excessively and the steel becomes very hard, impairing machinability and weldability. Therefore, the C content is set to 0.01% to 0.25%, preferably 0.07% to 0.11%.

Si: 0.01% to 0.7%

Si serves as a deoxidizer and enhances steam oxidization resistance of the steel. In order to obtain these effects, the Si content must be at least 0.01%. When the Si content is in excess of 0.7%, toughness of the steel is considerably impaired and creep strength of the steel declines. Therefore, the Si content is set to 0.01% to 0.7%, preferably 0.1% to 0.3%.

Mn: 0.01% to 1%

Mn serves as a deoxidizer when steel is molten during steelmaking. Mn improves hot-workability of steel by scarvenging S, and furthermore improves hardenability. In order to obtain these effects, the Mn content must be at least 0.01%. When the Mn content is in excess of 1%, fine carbonitride which has an effect of improving creep strength is coarsened, resulting in lowering creep strength of the steel when used under high-temperature conditions for a long period. Therefore, the Mn content is set to 0.1% to 1%, preferably 0.2% to 1%, more preferably 0.4% to 0.8%.

P: 0.03% or less, S: 0.015% or less

P and S, which are unavoidable impurity elements, are detrimental to toughness, machinability, and weldability of the steel, and especially increase temper embrittlement. For this reason, it is preferable that P and S are contained in steel in as small amounts as possible. The upper limit of P content is 0.03%, and the upper limit of S content is 0.015%.

Cr: 0.1% to 3%

Cr is essential to improvement of oxidization resistance and corrosion resistance. When the Cr content is less than 0.1%, these effects are not obtained. When the Cr content is in excess of 3%, cost increases, and advantages of Cr—Mo alloy steel are reduced. Therefore, the Cr content is set to 0.1% to 3%. Preferably, the Cr content is 1% to 1.5%, more preferably 1.1% to 1.3%.

Nb: 0.005% to 0.2%

Nb, together with Mo, combines with C and N, to thereby form MX-type precipitates, contributing to improvement of creep strength of the steel. When Nb is contained in MX, particles of the MX-type precipitates do not become large and thermal stability of the MX is enhanced, thereby suppressing the reduction in the creep strength of the steel when a long period of time has passed. Furthermore, Nb makes microcrystalline grains finer and thus improves weldability and toughness of the steel. When the Nb content is less than 0.005%, the precipitation amount of the MX is so small that Nb cannot contribute to improvement in creep strength of the steel, whereas when the Nb content is in excess of 0.2%, particles that precipitate tend to become large, resulting in lowering strength and toughness of the steel. Therefore, Nb content is set to 0.005% to 0.2%, preferably 0.02% to 0.08%, more preferably 0.03% to 0.05%. When the sum of the Nb content and the Mo content is less than 0.1%, precipitation strengthening by MX is not obtained. Therefore, the Nb content is set to satisfy the following formula: $0.1\% \leqq Nb+Mo$.

Mo: 0.01% to 2.5%

Mo has solution strengthening effect. Mo precipitates with Nb and V to form MX and has a precipitation strengthening effect, thereby improving creep strength of the steel. Furthermore, Mo prevents temper embrittlement and creep embrittlement, having an effect of improvement in toughness of the steel. However, when the Mo content is less than 0.01%, the above-mentioned effect is not obtained. When Mo content is in excess of 2.5%, the effect saturates and after heating the steel for a long time, large particles of carbide precipitate to impair strength and toughness of the steel. Therefore, Mo content is set to 0.01 to 2.5%, preferably 0.2% to 0.6%, more preferably 0.3% to 0.5%.

When the sum of the Nb content and the Mo content is less than 0.1%, precipitation strengthening by the MX is hot obtained. The Mo content satisfies the following formula. $0.1\% \leqq Nb+Mo$.

Ca: 0.0001% to 0.01%

Ca has an effect of reducing inclusions of the steel. In use of the steel as cast steel, Ca improves castability of the steel. Ca fixes S, which causes temper embrittlement and creep embrittlement, thereby contributing to improvement of toughness of the steel. When Ca is added in an amount of less than 0.0001%, the above-mentioned effect is not obtained, whereas the Ca content is in excess of 0.01%, carbide and sulfide increase, thereby impairing toughness and strength of the steel. Therefore, the Ca content is set to 0.0001% to 0.01%, preferably 0.0001% to 0.005%, more preferably 0.0001% to 0.0025%.

N: 0.0005% to 0.01%

N, together with C, combines with Nb, V, Ti, and Zr to form fine particles of carbonitride and thereby enhances creep strength. The carbonitride also provides fine microcrystalline grains, which improves toughness of the steel and prevents softening at HAZ. When the N content is less than 0.0005%, the above-mentioned effect is not obtained. In contrast, when the N content is in excess of 0.01%, particles of carbonitride become larger, thereby causing temper embrittlement and creep embrittlement. Therefore, the N content is set to 0.0005% to 0.01%, preferably 0.002% to 0.01%, more preferably 0.004 to 0.007%.

B: 0.0001% to 0.01%

B is an element strengthening grain boundaries and has an effect of preventing temper embrittlement and creep embrittlement. B provides finer carbides, thereby contributing to improvement of creep strength. When the B content is less than 0.0001%, the above-mentioned effect is not obtained. In contrast, when the B content is in excess of 0.01%, B enhances precipitation of carbides on grain boundaries, thereby impairing toughness of the steel. Therefore, B content is set to 0.0001% to 0.01%, preferably 0.001% to 0.003%, more preferably 0.002% to 0.004%.

V: 0.02% to 0.5%

V precipitates with Mo and Nb to form MX and to contribute to improvement of creep strength. V prevents precipitation of larger carbides at grain boundaries, stabilizing strength and toughness of the steel. To obtain the above-mentioned effect, the V content is preferably 0.02% or more. When the V content is in excess of 0.5%, the particles of MX tend to become larger, thereby impairing strength and toughness of the steel. Therefore, the V content is set to 0.02% to 0.5%, preferably 0.05% to 0.15%.

When the sum of the Nb content, Mo content, and V content is less than 0.1%, precipitation strengthening effect is not obtained sufficiently. Therefore, the V content must satisfy the following formula: $0.1\% \leqq Nb+Mo+V$. Among Nb, Mo, and V, V especially has a great precipitation strengthening effect, since V increases the precipitation density of MX.

Ti: 0.002–0.1%

Ti, similar to Nb, combines with C and N to form MX. Ti enhances creep strength and provides fine microcrystalline grains, and prevents softening of a heat affected zone (HAZ). Thus, Ti is added when such effect is required. When added into steel, the Ti content is preferably 0.002% or more. When the Ti content is in excess of 0.1%, Ti considerably hardens steel, thereby lowering toughness, workability and weldability. Thus, when Ti is added, the upper limit of Ti content is 0.1%. The Ti content is preferably 0.002–0.02%, more preferably 0.003–0.007%.

Cu: 0.5% or less

Cu is an austenite-stabilizing element and enhances thermal conductivity. Cu is an optional element. When Cu is added in excess of 0.5%, creep strength at high temperature and toughness decrease. Thus, when Cu is added, the upper limit of Cu content is 0.5%, and Cu content is preferably 0.05–0.3%, more preferably 0.1–0.2%.

Ni: 0.5% or less

Ni is an austenite-stabilizing element and enhances toughness. Ni is an optional element. When Ni is added in excess of 0.5%, creep strength at high temperature and toughness decrease. Addition of Ni in an excessive amount is also disadvantageous from the viewpoint of economy. Thus, when Ni is added, the upper limit of Ni content is 0.5%, and Ni content is preferably 0.05–0.3%, more preferably 0.1–0.2%.

Zr: 0.002–0.1%

Zr is an element which effectively serves as a deoxidizer. Zr prevents Ca from combining with oxygen when Ca is added and promotes S-fixing effect of Ca. Zr, similar to Nb, combines with C and N to form MX, thereby improving toughness through making microcrystalline grains fine and enhancing creep strength. Thus, Zr is optionally added into steel. When added, Zr is preferably added in an amount of 0.002% or more. Addition of Zr in excess of 0.1% readily coarsens MX particles, thereby lowering strength and toughness. Thus, when Zr is added, the upper limit of Zr content is 0.1%.

Al: 0.001–0.05%

Al is an element serving as a deoxidizer, and is optionally added into steel. In order to assure the effect, Al is preferably added in an amount of 0.001% or more, whereas addition of Al in excess of 0.05% lowers creep strength and Workability. Thus, when Al is added, the Al content is preferably 0.0005–0.05%, more preferably 0.001–0.01%.

Ta: 0.1% or less

Ta, similar to Ti, combines with C and N to form MX. Ta enhances creep strength, provides fine microcrystalline grains, and prevents softening of HAZ. Ta is an optional element. When added into steel, Ta in excess of 0.1% considerably hardens steel, thereby lowering toughness, workability and weldability. Thus, when Ta is added, the upper limit of Ta content is 0.1%, whereas the lower limit, which is not particularly limited, is preferably 0.01% or more.

Co: 0.5% or less

Co is an austenite-stabilizing element and has a solution-strengthening effect. Co is optionally added, and if it is present in excess of 0.5%, creep strength at high temperature decreases. Addition of Co in an excessive amount is also disadvantageous from the viewpoint of economy. Thus, when Co is added, the upper limit of Co content is 0.5%, whereas the lower limit, which is not particularly limited, is preferably 0.05% or more.

Mg: 0.01% or less

Mg is optionally added so as to scavenge P and S and prevent temper embrittlement and weld cracking. However, an Mg content in excess of 0.01% lowers toughness. Thus, when Mg is added, the upper limit of Mg content is 0.01%, whereas the lower limit, which is not particularly limited, is preferably 0.001% or more.

MX-type complex precipitates:

MX-type complex carbonitrides are precipitated as fine particles in inside grains. The average particle size of the MX-type complex precipitates is preferably controlled to 0.1 $\mu$m or less. The average particle size as used herein refers to an average size of all precipitates as measured through observation under a transmission electron microscope in 5 visual fields at a magnification factor of 100,000.

M in MX represents a metallic elements (e.g., Mo, Nb, V, Ti, Zr, or Ta) and X in MX represents C and N. MX means that metallic elements and C and N are combined at a ratio of 1:1. In general, MX broadly refers to carbonitrides such as NbC, NbN, Moc, MoN, VC, VN, ZrC, ZrN, TiC, TiN, TaC, and TaN, and complex precipitates thereof. In the steel of the present invention, MX refers to complex precipitates formed of the aforementioned carbonitrides. In the complex precipitates, various carbonitrides are present in a completely mixed condition. Examples include $(Nb_{12}Mo_{55}V_{26})$ (C, N). When NbC, NbN, MoC, MoN, VC, VN, ZrC, ZrN, TiC, TiN, TaC, and TaN are precipitated discretely or a certain precipitate is formed around another precipitate which acts as a nuclei of precipitation, specific precipitates are likely to coarsen remarkably. In contrast, when complex precipitates are formed, fine MX particles are homogeneously dispersed and precipitation strengthening is effectively attained even if the amounts of alloying elements are small. Therefore, complex precipitates are employed in the present invention. However, when Mo content is less than 30 mass % or Nb content is less than 7 mass % in MX, no effect of complex precipitation is obtained. In the case in which the steel contains V, no effect of complex precipitation is obtained when V content in MX is less than 10 mass %. Thus, the amounts of the metallic elements in MX; i.e., Mo content, Nb content, and V content, if V is contained, are controlled to 30 mass % or more, 7 mass % or more, and 10 mass % or more, respectively.

The M content in MX can be obtained through, for example, EDX analysis carried out by means of a transmission electron microscope.

The process for producing the steel of the present invention will be described next.

The heat-resistant steel according to the present invention is used in as cast condition or formed into various products by hot working such as forging and rolling. Steels having a chemical composition as defined by the present invention are subjected to the below-described heat treatment, to thereby form MX-type carbonitride satisfying a chemical composition falling within the range specified by the present invention.

(1) Normalizing after casting or forging

Normalizing is preferably carried out at a temperature which is higher than austenitic transformation starting temperature and within a temperature range where MX is present in a state of solid solution. Undissolved MX predominantly comprises NbN, NbC, TiN, and TiC which are separately precipitated and coarsened to large particles. Thus, the increase in amount of undissolved MX lowers creep strength and toughness. In addition, the greater the amount of undissolved MX is, the lower the precipitation density of fine MX particles that precipitate during tempering after normalizing or long-term aging is. Thus, a sufficient strengthening effect is not obtained. Specifically, when normalizing temperature is less than 950° C., undissolved MX particles coarsen and strength and toughness of steel are deteriorated. Therefore, normalizing temperature is preferably 950° C. or higher. The maximum normalizing temperature, which is not particularly limited, is preferably 1200° C. or lower where MX forms solid solution. Normalizing is effective for both as-cast steel and hot-worked steel.

(2) Finishing temperature after hot rolling

When steel is hot-rolled into the products such as steel sheets and steel tubes by hot rolling, the finishing temperature is controlled to 1100–900° C. during rolling in order to attain effectively uniform recrystallization and precipitation induced by work strain caused by hot rolling. When the temperature falls outside the range, dislocation is not accumulated and the effect of hot rolling is not attained. The maximum finishing temperature is preferably 1050° C., in view of cost. When controlled rolling is carried out, production cost may be lowered by saving energy, since normalizing can be omitted after hot rolling.

(3) Cooling after normalizing or hot rolling

Cr—Mo alloy steel is mostly subjected to bright normalizing in an inert atmosphere so as to prevent surface oxidation and decarburization. In this case, the cooling rate is 0.1° C./second or less.

However, the present invention is characterized by cooling conditions after normalizing or hot rolling. Specifically, in the present invention, cooling within the temperature range of 850° C. to 650° C. is carried out at an average cooling rate equal to or faster than both a cooling rate A represented by the following equation (1) and a cooling rate B represented by the following equation (2):

$$A=0.6\times\log(Nb)+1.24 \quad (1); \text{ and}$$

$$B=0.1\times\log(C+N)+0.3 \quad (2).$$

When the cooling rate is less than A, coarse NbC and NbN particles are precipitated during cooling, whereas when the cooling rate is less than B, coarse particles of carbides and nitrides other than NbC and NbN are precipitated, thereby lowering toughness and strength. In addition, when the cooling rate is less than A but not less than B, coarsening of particles of carbides and nitrides other than NbC and NbN is prevented but NbC particles and NbN particles are disadvantageously coarsened. In contrast, when the cooling rate is less than B but not less than A, coarsening of NbC particles and NbN particles is prevented but particles of carbides and nitrides other than NbC and NbN are coarsened. Thus, the average cooling rate must be controlled to a rate equal to or higher than A and equal to or higher than B; i.e., an average cooling rate is equal to or faster than both A and B.

Although no particular limitation is imposed on the upper limit of the cooling rate, the rate is preferably 20° C./second or less which corresponds to a water cooling rate in a practical manner. After completion of normalizing, steel must be cooled to room temperature so as to transform the metallurgical structure to martensite or bainite. When the temperature is in the range of 650° C. or lower, the control of the cooling rate is not required, and the steel may be allowed to stand for cooling. After completion of hot rolling, the steel must be cooled to 200° C. or lower at a cooling rate equal to or higher than both A and B within the temperature range of 850° C. to 650° C. so as to prevent a precipitation of coarse NbN and NbC. When the temperature is in the range of 650° C. or lower, the control of the cooling rate is not required, and the steel may be allowed to stand for cooling. Since an accumulation of work strain caused by controlled rolling elevates the transformation temperature, the steel is not necessarily cooled to room temperature so long as the steel is cooled to 200° C. or lower.

(4) Tempering

Tempering is an important step for precipitating MX-type carbonitrides and is carried out within a temperature range of C(° C.) to D(° C.) defined by the following formulas (3) and (4):

$$C=780-125\times Mo/(Mo+Nb) \quad (3); \text{ and}$$

$$D=780+100\times Nb/(Mo+Nb) \quad (4).$$

When the tempering temperature is lower than C(° C.), Nb content in MX becomes less than 7% and strengthening effect is poor. In addition, film-like carbides are precipitated in grain boundaries, thereby lowering toughness. When the tempering temperature is more than D(° C.), Mo content in MX becomes less than 30%, thereby lowering strength and ductility. When the steel contains V and the tempering temperature is lower than C(° C.) or more than D(° C.), V content in MX becomes less than 10% and desired strength and toughness cannot be obtained. Thus, the tempering temperature is preferably controlled within the range of C(° C.) to D(° C.).

EXAMPLES

In a 150-kg vacuum melting furnace, 27 steel samples having a chemical composition shown in Tables 1 and 2 were each melted.

TABLE 1

(balance Fe, mass %)

| No. | C | Si | Mn | P | S | Cr | Mo | Nb | V | Zr | Ti | Ta | B | N | Ca | Al | Other elements | Remarks |
|---|---|---|---|---|---|---|---|---|---|---|---|---|---|---|---|---|---|---|
| 1 | 0.08 | 0.25 | 0.28 | 0.009 | 0.002 | 1.24 | 1.13 | 0.050 | 0.13 | — | — | — | 0.0003 | 0.003 | 0.0024 | 0.001 | | Samples |
| 2 | 0.20 | 0.24 | 0.29 | 0.011 | 0.002 | 1.15 | 1.07 | 0.050 | 0.10 | — | — | — | 0.004 | 0.004 | 0.0013 | 0.001 | | according |
| 3 | 0.11 | 0.25 | 0.31 | 0.008 | 0.002 | 1.26 | 1.11 | 0.008 | 0.13 | — | — | — | 0.004 | 0.004 | 0.0014 | 0.001 | | to the |
| 4 | 0.09 | 0.24 | 0.05 | 0.009 | 0.005 | 1.23 | 0.87 | 0.060 | — | 0.20 | — | 0.010 | 0.004 | 0.005 | 0.0048 | 0.001 | | invention |
| 5 | 0.07 | 0.08 | 0.30 | 0.007 | 0.002 | 2.27 | 0.93 | 0.080 | 0.10 | — | — | — | 0.004 | 0.004 | 0.0017 | 0.001 | | |
| 6 | 0.18 | 0.23 | 0.29 | 0.011 | 0.002 | 0.23 | 1.03 | 0.050 | — | — | — | — | 0.004 | 0.004 | 0.0014 | 0.001 | | |
| 7 | 0.03 | 0.25 | 0.30 | 0.012 | 0.003 | 2.25 | 1.24 | 0.050 | 0.11 | 0.010 | — | 0.010 | 0.007 | 0.009 | 0.0012 | 0.001 | | |
| 8 | 0.08 | 0.24 | 0.53 | 0.007 | 0.002 | 1.24 | 1.01 | 0.050 | — | — | — | — | 0.004 | 0.005 | 0.0022 | 0.001 | | |
| 9 | 0.11 | 0.25 | 0.29 | 0.008 | 0.005 | 2.75 | 1.15 | 0.050 | — | 0.010 | — | — | 0.003 | 0.004 | 0.0053 | 0.001 | | |
| 10 | 0.10 | 0.24 | 0.31 | 0.011 | 0.002 | 1.18 | 2.10 | 0.050 | — | — | — | — | 0.004 | 0.004 | 0.0021 | 0.001 | | |
| 11 | 0.10 | 0.24 | 0.30 | 0.009 | 0.002 | 1.25 | 1.12 | 0.150 | — | — | — | — | 0.004 | 0.004 | 0.0025 | 0.001 | | |

TABLE 1-continued (balance Fe, mass %)

| No. | C | Si | Mn | P | S | Cr | Mo | Nb | V | Zr | Ti | Ta | B | N | Ca | Al | Other elements | Remarks |
|---|---|---|---|---|---|---|---|---|---|---|---|---|---|---|---|---|---|---|
| 12 | 0.12 | 0.25 | 0.29 | 0.010 | 0.002 | 1.21 | 0.74 | 0.050 | — | — | — | — | 0.004 | 0.001 | 0.0019 | 0.002 | | |
| 13 | 0.11 | 0.24 | 0.30 | 0.010 | 0.002 | 1.35 | 1.03 | 0.060 | — | — | 0.010 | 0.010 | 0.004 | 0.008 | 0.0018 | 0.001 | | |
| 14 | 0.07 | 0.25 | 0.48 | 0.010 | 0.002 | 1.25 | 0.35 | 0.040 | 0.10 | — | 0.007 | — | 0.003 | 0.005 | 0.0025 | 0.002 | Cu:0.15, Ni:0.15 | |
| 15 | 0.10 | 0.24 | 0.52 | 0.009 | 0.002 | 1.18 | 0.46 | 0.030 | 0.08 | — | 0.010 | — | 0.004 | 0.006 | 0.0021 | 0.001 | Cu:0.16, Ni:0.14, Mg:0.001 | |
| 16 | 0.08 | 0.35 | 0.45 | 0.013 | 0.002 | 1.23 | 0.32 | 0.050 | 0.09 | 0.005 | 0.005 | — | 0.002 | 0.004 | 0.0031 | 0.002 | Cu:0.13, Ni:0.28 | |
| 17 | 0.08 | 0.26 | 0.55 | 0.012 | 0.001 | 1.10 | 0.50 | 0.040 | 0.10 | — | 0.008 | 0.005 | 0.003 | 0.005 | 0.0027 | 0.002 | Cu:0.12, Ni:0.15, Co:0.10 | |
| 18 | 0.10 | 0.25 | 0.35 | 0.011 | 0.002 | 1.20 | 0.45 | 0.050 | — | — | 0.010 | — | 0.003 | 0.005 | 0.0023 | 0.001 | | |

TABLE 2

(balance Fe, mass %)

| No. | C | Si | Mn | P | S | Cr | Mo | W | Nb | V | Zr | Ti | Ta | B | N | Ca | Al | Remarks |
|---|---|---|---|---|---|---|---|---|---|---|---|---|---|---|---|---|---|---|
| A | 0.06 | 0.25 | 0.31 | 0.012 | 0.003 | 1.25 | 1.07 | — | 0.060 | 0.10 | — | — | — | —* | 0.007 | 0.0020 | 0.002 | Comparative |
| B | 0.12 | 0.24 | 0.30 | 0.011 | 0.005 | 1.24 | 1.12 | — | 0.050 | 0.05 | — | — | — | 0.005 | 0.004 | —* | 0.001 | samples |
| C | 0.08 | 0.24 | 0.35 | 0.010 | 0.003 | 0.01* | 0.95 | — | 0.060 | — | — | — | — | 0.004 | 0.005 | 0.0023 | 0.001 | |
| D | 0.005* | 0.25 | 0.32 | 0.011 | 0.002 | 1.18 | 1.11 | — | 0.050 | — | — | — | — | 0.004 | — | 0.0018 | 0.002 | |
| E | 0.13 | 0.26 | 0.30 | 0.010 | 0.003 | 1.25 | 1.01 | — | 0.070 | — | — | — | — | 0.014* | 0.011 | 0.0024 | 0.002 | |
| F | 0.11 | 0.25 | 0.31 | 0.010 | 0.002 | 1.21 | 0.88 | — | —* | — | — | — | — | 0.005 | 0.004 | 0.0019 | 0.001 | |
| G | 0.12 | 0.32 | 0.28 | 0.012 | 0.003 | 1.24 | 2.71* | — | 0.050 | 0.10 | — | — | 0.01 | 0.006 | 0.005 | 0.0025 | 0.001 | |
| H | 0.31* | 0.27 | 0.27 | 0.011 | 0.002 | 1.88 | 1.41 | — | 0.080 | — | — | — | — | 0.004 | 0.005 | 0.0028 | 0.002 | |
| I | 0.11 | 0.26 | 0.31 | 0.010 | 0.001 | 1.08 | 0.96 | — | 0.070 | — | — | — | — | 0.005 | 0.004 | 0.0153* | 0.002 | |

*Falling outside the range specified by the invention

The following three types of working processes involving casting and tempering were carried out.

(1) Ingot—machining—normalizing—tempering (cast NT)

An ingot was machine-worked to produce a steel sheet having a thickness of 50 mm, which was then normalized and tempered.

(2) Ingot—hot forging—normalizing—tempering (NT)

An cast ingot was forged at 1200–1000° C. to produce a steel sheet having a thickness of 50 mm, which was then normalized and tempered.

(3) Ingot—forging—hot rolling—normalizing—tempering (DQT)

An cast ingot was forged at 1200–1000° C. to produce a steel sheet having a thickness of 100 mm. The sheet was heated to 1250° C., hot-rolled and finished at a temperature selected from a range of 800 to 1050° C., and then cooled to room temperature at a rate shown in Table 3. The thus-obtained steel sheet was tempered. Detailed heat treatment conditions are shown in Table 3.

TABLE 3

| No. | Process* | Normalizing temperature (° C.) | Roll-finishing temperature (° C.) | Cooling rate (° C./sec) Measured | A | B | Tempering temperature (° C.) Performed | C | D | Nb, Mo, V contents in MX (mass %) Nb | Mo | V | Remarks |
|---|---|---|---|---|---|---|---|---|---|---|---|---|---|
| 1 | NT | 1150 | — | 2 | 0.46 | 0.19 | 760 | 660 | 784 | 12 | 55 | 26 | Samples |
| 2 | Cast NT | 1150 | — | 2 | 0.46 | 0.23 | 760 | 661 | 784 | 18 | 50 | 24 | according to |
| 3 | DQT | — | 1050 | 0.3 | 0 | 0.21 | 760 | 655 | 781 | 15 | 52 | 28 | the invention |
| 4 | NT | 1150 | — | 2 | 0.51 | 0.20 | 760 | 663 | 786 | 60 | 35 | — | |
| 5 | DQT | — | 1000 | 2 | 0.58 | 0.19 | 770 | 665 | 788 | 17 | 50 | 25 | |
| 6 | Cast NT | 1150 | — | 2 | 0.46 | 0.23 | 750 | 661 | 785 | 60 | 35 | — | |
| 7 | NT | 1000 | — | 2 | 0.46 | 0.16 | 740 | 660 | 784 | 12 | 52 | 27 | |
| 8 | DQT | — | 950 | 2 | 0.46 | 0.19 | 760 | 661 | 784 | 60 | 35 | — | |
| 9 | DQT | — | 1050 | 2 | 0.46 | 0.21 | 770 | 660 | 784 | 61 | 34 | — | |
| 10 | NT | 1200 | — | 2 | 0.46 | 0.20 | 760 | 658 | 782 | 60 | 35 | — | |
| 11 | DQT | — | 1050 | 2 | 0.75 | 0.20 | 760 | 670 | 792 | 60 | 34 | — | |
| 12 | DQT | — | 1050 | 2 | 0.46 | 0.21 | 760 | 663 | 786 | 60 | 35 | — | |
| 13 | DQT | — | 1050 | 2 | 0.51 | 0.21 | 760 | 662 | 786 | 61 | 35 | — | |
| 14 | NT | 975 | — | 2 | 0.40 | 0.19 | 730 | 668 | 790 | 15 | 45 | 40 | |
| 15 | NT | 975 | — | 2 | 0.33 | 0.20 | 725 | 663 | 786 | 17 | 55 | 28 | |
| 16 | NT | 950 | — | 2 | 0.46 | 0.19 | 725 | 672 | 794 | 18 | 40 | 42 | |
| 17 | NT | 975 | — | 2 | 0.40 | 0.19 | 725 | 664 | 787 | 20 | 55 | 25 | |

TABLE 3-continued

| No. | Process* | Normalizing temperature (° C.) | Roll-finishing temperature (° C.) | Cooling rate (° C./sec) Measured | A | B | Tempering temperature (° C.) Performed | C | D | Nb, Mo, V contents in MX (mass %) Nb | Mo | V | Remarks |
|---|---|---|---|---|---|---|---|---|---|---|---|---|---|
| 18 | NT | 970 | — | 2 | 0.46 | 0.20 | 730 | 668 | 790 | 15 | 40 | 45 | |
| A* | DQT | — | 1050 | 2 | 0.51 | 0.18 | 760 | 662 | 785 | 13 | 50 | 25 | |
| B* | DQT | — | 1000 | 2 | 0.46 | 0.21 | 760 | 660 | 784 | 18 | 50 | 22 | |
| C* | NT | 1150 | — | 2 | 0.51 | 0.19 | 720 | 662 | 786 | 61 | 36 | — | |
| D* | DQT | — | 1000 | 2 | 0.46 | 0.07 | 760 | 660 | 784 | No complex precipitate formed* | | | Comparative Samples |
| E* | DQT | — | 1000 | 2 | 0.55 | 0.21 | 760 | 663 | 786 | 60 | 35 | — | |
| F* | NT | 1150 | — | 2 | — | 0.21 | 760 | 655 | 780 | —* | 95 | — | |
| G* | DQT | — | 1000 | 2 | 0.46 | 0.21 | 760 | 657 | 782 | 13 | 52 | 25 | |
| H* | DQT | — | 1000 | 2 | 0.58 | 0.25 | 770 | 662 | 785 | 61 | 33 | — | |
| I* | DQT | — | 1000 | 2 | 0.55 | 0.21 | 760 | 663 | 787 | 60 | 35 | — | |
| 1 | DQT | — | 800* | 0.25* | 0.46 | 0.19 | 760 | 660 | 784 | No complex precipitate formed* | | | |
| 3 | DQT | — | 1000 | 0.1* | 0.46 | 0.23 | 760 | 661 | 784 | 5* | 54 | 34 | |
| 4 | DQT | — | 1000 | 2 | 0 | 0.21 | 550* | 655 | 781 | 5* | 88 | 2* | |

*Falling outside the range specified by the invention
In No. column, * denotes a Chemical composition failing outside the range specified by the invention.
**Cast NT: Ingot - machining - normalizing - tempering
NT: Ingot - hot forging - normalizing - tempering
DQT: Ingot - hot forging - hot rolling - normalizing - tempering
$A = 0.6 \times \log(Nb) + 1.24$ $C = 780 - 125 \times Mo/(Mo + Nb)$
$B = 0.1 \times \log(C + N) + 0.3$ $D = 780 + 100 \times Nb/(Mo + Nb)$ Test sample for the extraction replica were obtained from each tempered steel sheet. The composition of MX-type carbonitride of each test sample was measured through EDX (energy dispersive X-ray) analysis with observation under an FEG (field emission electron gun) transmission electron microscope. Since an FEG transmission electron microscope can narrow the electron beam to a few nm or less, MX-type carbonitride particles of a few nm or less can be measured with accuracy. The number of measured particles was 20. The Nb content, Mo content, and V content are shown in Table 2.

A creep test and the Charpy impact test were carried out so as to evaluate high-temperature strength and toughness of steel samples.

In the creep test, test pieces having a diameter of 6 mm and a parallel length of 30 mm were prepared, and the tests were carried out at 525° C. for up to 10,000 hours, to thereby obtain average fracture strength. The fracture strength (525° C.×1000 hours) and the fracture strength (525° C.×10,000 hours) were compared, to thereby obtain a lowering ratio of fracture strength, which serves as an index of stability of strength at high-temperature.

The Charpy impact test was carried out by use of 2-mm-V-notched test pieces with a size of 10×10×55 (mm). Ductile-brittle fracture appearance transition temperature was evaluated at 10° C., −10° C., and −25° C. The results are shown in Table 4.

TABLE 4

| No. | Creep strength 525° C.× 10,000 h average strength (MPa) | Ratio of lowering strength 525° C. × 1000 h → 10,000 h (%) | Ductile-brittle fracture appearance transition temperature (° C.) | Remarks |
|---|---|---|---|---|
| 1 | 181 | 20 | ≦−10 | Samples according to the |
| 2 | 202 | 21 | ≦−10 | |
| 3 | 199 | 19 | ≦−10 | |

TABLE 4-continued

| No. | Creep strength 525° C.× 10,000 h average strength (MPa) | Ratio of lowering strength 525° C. × 1000 h → 10,000 h (%) | Ductile-brittle fracture appearance transition temperature (° C.) | Remarks |
|---|---|---|---|---|
| 4 | 183 | 22 | ≦−10 | invention |
| 5 | 204 | 18 | ≦−10 | |
| 6 | 172 | 20 | ≦−10 | |
| 7 | 173 | 21 | ≦−10 | |
| 8 | 182 | 19 | ≦−10 | |
| 9 | 205 | 20 | ≦−10 | |
| 10 | 189 | 19 | ≦−10 | |
| 11 | 192 | 18 | ≦−10 | |
| 12 | 180 | 19 | ≦−10 | |
| 13 | 183 | 21 | ≦−10 | |
| 14 | 195 | 14 | ≦−25 | |
| 15 | 201 | 15 | ≦−25 | |
| 16 | 189 | 12 | ≦−25 | |
| 17 | 192 | 13 | ≦−25 | |
| 18 | 182 | 11 | ≦−25 | |
| A | 141 | 20 | ≦−10 | Comparative samples |
| B | 179 | 21 | >10 | |
| C | 142 | 20 | ≦−10 | |
| D | 123 | 16 | >10 | |
| F | 179 | 37 | >10 | |
| G | 142 | 35 | ≦−10 | |
| H | 180 | 38 | >10 | |
| I | 201 | 40 | >10 | |
| K | 172 | 20 | >10 | |
| 1 | 162 | 35 | >10 | |
| 3 | 174 | 38 | >10 | |
| 4 | 178 | 37 | >10 | |

Among Comparative Samples, Sample A, to which no B is added, contains a small amount of fine carbonitride particles and exhibits low creep strength.

Similarly, Sample B, to which no Ca is added, is prone to temper embrittlement and has poor toughness.

Sample C, of low Cr content, is prone to steam oxidation and shows low creep strength.

Sample D, of low C content and low N content, contains no MX-type carbonitride precipitate and shows low creep strength.

Sample E, to which excessive B is added, contains coarse carbide particles in grain boundaries and shows low toughness.

Sample F, to which no Nb is added, contains no fine MX particles having a chemical composition according to the present invention, and exhibits low creep strength.

In Sample G, to which excessive Mo is added, carbide particles are coarsened after long-term aging, and the lowering ratio of long-term strength is large.

In Sample H, to which excessive C is added, carbide particles are tend to be coarsened after long-term aging, and residual stress is not relaxed, thereby providing poor toughness.

Sample I, to which excessive Ca is added, contains undissolved coarse impurities and exhibits poor toughness.

Samples 2 and 3 have a chemical composition falling within the range according to the present invention (hereinafter referred to as the defined range). However, heat treatment of two samples was inappropriate, thereby failing to provide the defined chemical composition to MX. Therefore, creep strength and toughness are unsatisfactory. Sample 4 has a chemical composition falling within the defined range. However, tempering temperature condition of Sample 4 was inappropriate, thereby failing to impart defined chemical composition to MX. Therefore, creep strength and toughness are unsatisfactory.

In contrast, steel samples according to the present invention show stable strength; i.e., an average creep strength (525° C.×10,000 hours) shows 170 MPa or more and a ratio of lowering fracture strength from 1000 hours to 10,000 hours, at 525° C. is 20% or less. These samples also show excellent toughness; i.e., a ductile-brittle fracture appearance transition temperature is −25° C. or less.

The present invention provides Cr—Mo alloy steel which shows excellent toughness and high creep fracture strength even after the steel is used at 400–600° C. for a long period of time. Thus, the alloy steel can be employed as a heavy wall steel member which requires toughness and also employed as material in which high-Cr ferritic steel has been conventionally used. The alloy steel has economical advantage.

What is claimed is:

1. A Cr—Mo alloy steel consisting essentially of, on a mass % basis,

| | |
|---|---|
| C: 0.01–0.25%, | Si: 0.01–0.7% |
| Mn: 0.01–1%, | P: 0.03% or less, |
| S: 0.015% or less, | Cr: 0.1–3%, |
| Nb: 0.005–0.2%, | Mo: 0.01–2.5%, |
| Ca: 0.0001–0.01%, | N: 0.0005–0.01%, |
| B: 0.0001–0.01%, | |
| with the balance being Fe and impurities, and which satisfies the following expression: 0.1 < Nb + Mo | |

wherein each element symbol denotes content thereof (mass %), wherein MX complex precipitates are formed inside microcrystalline grains of the steel, the M in the MX complex precipitates representing the above metallic elements, the X in the MX complex precipitates representing C and N, and the total amount of Mo in the MX complex precipitates is 30 mass % or more, and the total amount of Nb in the MX complex precipitates is 7 mass % or more.

2. A Cr—Mo alloy steel according to claim 1, wherein Ti is contained in an amount of 0.002 to 0.1 mass %.

3. A Cr—Mo alloy steel according to claim 1, wherein either one or both of 0.05 to 0.5 mass % Ni and 0.05 to 0.5 mass % Cu are contained.

4. A Cr—Mo alloy steel according to claim 2, wherein 0.002 to 0.1 mass % Ti, and either one or both of 0.05 to 0.5 mass % Ni and 0.05 to 0.5 mass % Cu are contained.

5. A Cr—Mo alloy steel consisting essentially of, on a mass % basis,

| | |
|---|---|
| C: 0.07–0.11%, | Si: 0.1–0.3% |
| Mn: 0.2–1%, | P: 0.03 or less |
| S: 0.015 or less | Cr: 1–1.5% (1.5% not included), |
| Nb: 0.02–0.08%, | Mo: 0.2–0.6%, |
| Ca: 0.0001–0.005%, | N: 0.002–0.01%, |
| B: 0.001–0.003%, | |

with the balance being Fe and impurities, and which satisfies the following expression:

$$0.1<Nb+Mo$$

wherein each element symbol denotes content thereof (mass %), wherein MX complex precipitates are formed inside microcrystalline grains of the steel, the M in the MX complex precipitates representing the above metallic elements, the X in the MX complex precipitates representing C and N, and the total amount of Mo in the MX complex precipitates is 30 mass % or more, and the total amount of Nb in the MX complex precipitates is 7 mass % or more.

6. A Cr—Mo alloy steel according to claim 5, wherein Ti is contained in an amount of 0.002 to 0.1 mass %.

7. A Cr—Mo alloy steel according to claim 5, wherein either one or both of 0.05 to 0.5 mass % Ni and 0.05 to 0.5 mass % Cu are contained.

8. A Cr—Mo alloy steel according to claim 5, wherein 0.002 to 0.1 mass % Ti, and either one or both of 0.05 to 0.5 mass % Ni and 0.05 to 0.5 mass % Cu are contained.

9. A Cr—Mo alloy steel consisting essentially of, on a mass % basis,

| | |
|---|---|
| C: 0.07–0.11%, | Si: 0.1–0.3% |
| Mn: 0.2–1%, | P: 0.03 or less |
| S: 0.015 or less | Cr: 1–1.5% (1.5% not included), |
| Nb: 0.02–0.08%, | Mo: 0.2–0.6%, |
| Ca: 0.0001–0.005%, | N: 0.002–0.01%, |
| B: 0.001–0.003%, | V: 0.05–0.15%, |
| Ti: 0.002–0.02%, | |

with the balance Fe and impurities, and which satisfies the following expression:

$$0.1<Nb+Mo+V$$

wherein each element symbol denotes content thereof (mass %), wherein MX complex precipitates are formed inside microcrystalline grains of the steel, the M in the MX complex precipitates representing the above metallic elements, the X in the MX complex precipitates representing C and N, and the total amount of Mo in the MX complex precipitates is 30 mass % or more, and the total amount of Nb in the MX complex precipitates is 7 mass % or more.

10. A Cr—Mo alloy steel, consisting essentially of, on a mass % basis,

| | |
|---|---|
| C: 0.07–0.11%, | Si: 0.1–0.3% |
| Mn: 0.2–1%, | P: 0.03 or less |
| S: 0.015 or less | Cr: 1–1.5% (1.5% not included), |
| Nb: 0.02–0.08%, | Mo: 0.2–0.6%, |
| Ca: 0.0001–0.005%, | N: 0.002–0.01%, |
| B: 0.001–0.003%, | V: 0.05–0.15%, |

either one or both of 0.05 to 0.3% Ni and 0.05 to 0.3% Cu, with the balance Fe and impurities, and which satisfies the following expression:

$$0.1<Nb+Mo+V$$

wherein each element symbol denotes content thereof (mass %), wherein MX complex precipitates are formed inside microcrystalline grains of the steel, the M in the MX complex precipitates representing the above metallic elements, the X in the MX complex precipitates representing C and N, and the total amount of Mo in the MX complex precipitates is 30 mass % or more, and the total amount of Nb in the MX complex precipitates is 7 mass % or more.

11. A Cr—Mo alloy steel which comprises, on a mass % basis,

| | |
|---|---|
| C: 0.07–0.11%, | Si: 0.1–0.3% |
| Mn: 0.2–1%, | P: 0.03 or less |
| S: 0.015 or less | Cr: 1–1.5% (1.5% not included), |
| Nb: 0.02–0.08%, | Mo: 0.2–0.6%, |
| Ca: 0.0001–0.005%, | N: 0.002–0.01%, |
| B: 0.001–0.003%, | V: 0.05–0.15%, |
| Ti: 0.002–0.02%, | |

either one or both of 0.05 to 0.3% Ni and 0.05 to 0.3% Cu, with the balance Fe and impurities, and which satisfies the following expression:

$$0.1<Nb+Mo+V$$

wherein each element symbol denotes content thereof (mass %), wherein MX complex precipitates are formed inside microcrystalline grains of the steel, the M in the MX complex precipitates representing the above metallic elements, the X in the MX complex precipitates representing C and N, and the total amount of Mo in the MX complex precipitates is 30 mass % or more, and the total amount of Nb in the MX complex precipitates is 7 mass % or more.

12. A Cr—Mo steel according to claim 1, further consisting essentially of sol. Al having a range of 0–0.05%.

13. A Cr—Mo steel according to claim 5, further consisting essentially of sol. Al having a range of 0–0.05%.

* * * * *

UNITED STATES PATENT AND TRADEMARK OFFICE

CERTIFICATE OF CORRECTION

PATENT NO. : 6,358,336 B1
DATED : March 19, 2002
INVENTOR(S) : Miyata

It is certified that error appears in the above-identified patent and that said Letters Patent is hereby corrected as shown below:

Title page,
Item [54], title should read -- HEAT RESISTANT CR-MO ALLOY STEEL --
Item [56], References Cited, FOREIGN PATENT DOCUMENTS:
JP 09217146 08/1997

Signed and Sealed this

Third Day of September, 2002

*Attest:*

*Attesting Officer*

JAMES E. ROGAN
*Director of the United States Patent and Trademark Office*